US005908667A

United States Patent [19]

Blum et al.

[11] Patent Number: 5,908,667

[45] Date of Patent: Jun. 1, 1999

[54] MULTILAYER LACQUERING PROCESS

[75] Inventors: Joachim Blum, Remscheid; Dieter Stranghöner, Sprockhövel; Dieter Engel; Klausjörg Klein, both of Wuppertal; Walter Kühhirt, Remscheid; Matthias Kimpel; Friedrich-Ludwig Siever, both of Schwelm, all of Germany

[73] Assignee: Herberts Gesellschaft mit beschrankter Haftung, Wuppertal, Germany

[21] Appl. No.: 08/952,684

[22] PCT Filed: May 24, 1996

[86] PCT No.: PCT/EP96/02233

§ 371 Date: Nov. 25, 1997

§ 102(e) Date: Nov. 25, 1997

[87] PCT Pub. No.: WO96/38234

PCT Pub. Date: Dec. 5, 1996

[30] Foreign Application Priority Data

May 30, 1995 [DE] Germany ..... 195 19 667

[51] Int. Cl.[6] ..... B05D 1/38; B05D 7/26; B05D 3/02

[52] U.S. Cl. ..... 427/407.1; 427/195; 427/379; 427/409; 427/458

[58] Field of Search ..... 427/407.1, 409, 427/410, 458, 379, 380

[56] References Cited

U.S. PATENT DOCUMENTS

| | | | |
|---|---|---|---|
| 3,674,671 | 7/1972 | Stromberg | 204/181 |
| 4,755,418 | 7/1988 | DebRoy et al. | 427/409 |
| 4,882,090 | 11/1989 | Batzill et al. | 252/511 |
| 4,911,811 | 3/1990 | Mullaney, Jr. | 427/409 |
| 4,933,214 | 6/1990 | Sugiura et al. | 427/379 |
| 5,114,756 | 5/1992 | Mirabeau et al. | 427/379 |
| 5,203,975 | 4/1993 | Richardson | 204/181.1 |
| 5,389,406 | 2/1995 | Doebler et al. | 427/407.1 |
| 5,395,659 | 3/1995 | Graf et al. | 427/407.1 |
| 5,425,970 | 6/1995 | Lahrmann et al. | 427/493 |
| 5,507,928 | 4/1996 | Bohmert et al. | 204/488 |
| 5,721,018 | 2/1998 | Goldner et al. | 427/407.1 |

FOREIGN PATENT DOCUMENTS

| | | |
|---|---|---|
| 0 402 181 | 12/1990 | European Pat. Off. . |
| 0 426 327 | 5/1991 | European Pat. Off. . |
| 0 548 845 | 6/1993 | European Pat. Off. . |
| 2 335 270 | 7/1977 | France . |
| 2 129 807 | 5/1984 | United Kingdom . |
| WO86/03791 | 7/1986 | WIPO . |
| WO91/12899 | 9/1991 | WIPO . |

*Primary Examiner*—Diana Dudash
*Attorney, Agent, or Firm*—Pillsbury Madison & Sutro LLP

[57] ABSTRACT

Process for producing a multilayer lacquer coating, in which a primer of an electrophoretically depositable aqueous coating agent (1) is electrophoretically applied on to an electrically conductive substrate and is then stoved, whereupon a color-giving and/or effect-producing base lacquer coat of an aqueous coating agent (II) is applied and stoved and this coat is then provided with one or more clear lacquer coatings, in which process a) as the coating agent (I), a coating agent which, in the stoved state, will produce an electrically conductive primary coat is used, b) the base lacquer coat is formed by an electrophoretically depositable aqueous coating agent (II) by a process of electrophoretical deposition, c) the overall dry layer thickness of the dry lacquer coat or dry lacquer coats is about 40 and 80 $\mu$m, and d) the overall dry layer thickness of the multilayer lacquer coating is about 80 to 110 $\mu$m.

7 Claims, No Drawings

MULTILAYER LACQUERING PROCESS

This application is the national phase of international application PCT/EP96102233, filed May 24, 1996 which designated the U.S.

The invention relates to a process for preparing a multilayer lacquer coating for conductive, in particular metallic, substrates which is particularly well suited for the lacquer-coating of motor vehicles.

Present-day high-grade lacquers for the assembly-line lacquering of motor vehicles generally comprise an electrophoretically applied anticorrosive primer and subsequent coats which are then applied by spraying and comprise a filler layer and a subsequent layer which is applied for decorative purposes and consists of a colour-giving and/or effect-producing base coat, and a protective clear lacquer coat which seals the surface.

The overall thickness of such motor vehicle lacquers is, in practice, between 90 and 130 $\mu$m which is the total produced by a layer thickness of 15 to 25 $\mu$m for the primer, 30 to 40 $\mu$m for the filler layer, 10 to 25 $\mu$m for the base lacquer coat and 30 to 40 $\mu$m for the clear lacquer coat. These layer thicknesses are far greater when it is intended to produce lacquer coatings which have a particularly good optical appearance, i.e. with a prominent luster and coating lacquer condition, for example, when lacquer-coating motor vehicles in the upper and luxury classes. The application of a plurality of clear lacquer coats no to a base lacquer coat is described, for example, in DE-A-42 15 070 and DE-A-38 39 905. In such cases, layer thicknesses exceeding 120 $\mu$m, for example up to 170 $\mu$m, are produced, but this is undesirable for reasons relating to savings in the materials used and to reduction of the mass of the finished vehicle.

The object of the invention is to provide multilayer lacquer coatings, in particular motor vehicle lacquers, which meet the requirements with regard to a prominent luster and coating lacquer condition, without exceeding the standard measure for overall layer thicknesses for motor vehicle lacquer coatings, and without any concomitant disadvantages in the overall level of properties.

It has been found that it was possible to meet this object in a novel manner according to the invention by a process f or producing a multilayer lacquer coating, in which a primer of an electrophoretically depositable aqueous coating agent (1) is electrophoretically applied on to an electrically conductive substrate and is then stoved, whereupon a colour-giving and/or effect-producing base lacquer of an aqueous coating agent (II) is applied and stoved and this coat is then provided with one or more clear lacquer coatings, according to which process a) as the coating agent (I), a coating agent which, in the stoved state, will produce an electrically conductive primary coat is used, b) the base lacquer coat is formed by an electrophoretically depositable aqueous coating agent (II) by a process of electrophoretical deposition, c) the overall dry layer thickness of the dry lacquer coat or dry lacquer coats is about 40 and 80 $\mu$m, and d) the overall dry layer thickness of the multilayer lacquer coating is about 80 to 110 $\mu$m.

Within the framework of the multilayer lacquer coatings according to the invention, a clear lacquer coat having a substantial thickness of 40 to 80 $\mu$m, preferably 50 to 60 $\mu$m, is provided. This coat is applied on to the stoved base lacquer coat. The clear lacquer coat may comprise one or more layers, the first clear lacquer layer preferably being stoved prior to application of the additional clear lacquer coats. A plurality of clear lacquer coats may be provided to be from the same or from different clear lacquer coating agents.

In the process according to the invention, it is possible to use, as the electrophoretically depositable but different coating agents (I) and (II), anodically or cathodically depositable electro-dipcoats (ETL), which are known per se, to produce the first and the second coating layer, it being imperative that the electrophoretically depositable coating agent (I) contain components which give an adequately low specific resistance to the first coating layer, in the stoved state, for the electrophoretic depositing of a further coating layer of an electrophoretically depositable coating agent (II) which differs from (I), and that the electrophoretically depositable coating agent (II) contain colour-giving and/or effect-producing pigments.

The coating agents (I) and (II) are aqueous coating agents having a solids content of, for example, 10 to 20% by mass. This solids content comprises the usual binding agents, at least a part of the binding agents containing ionic substituents and/or substituents which may be converted into ionic groups, and, if required, groups which are capable of chemical cross-linking, and, optionally, any cross-linking agents which are present, electrically conductive components, filler substances, pigments and the usual additives for lacquers.

The ionic groups or the groups which are capable of being converted into ionic groups in the binding agents may be anionic groups or groups which may be converted into anionic groups, acid groups, such as —COOH, —$SO_3H$ and/or —$PO_3H_2$, and the corresponding anionic groups neutralized with bases. They may also be cationic groups, or groups which are capable of being converted into cationic groups, e.g. basic groups, preferably nitrogenous basic groups; these groups may be present in guaternary form, or they may be converted into ionic groups using a usual neutralizing agent, e.g. an organic monocarboxylic acid, such as, for example, formic acid or acetic acid. Examples are amino groups, ammonium groups, e.g. quaternary ammonium, phosphonium and/or sulphonium groups.

In the process according to the invention, to produce the first and/or second coating layers, it is possible to use, for example, the usual anodically depositable electro-dipcoat binding agents and lacquers (ATL) containing anionic groups. Examples hereof are described in DE-A-28 24 418. They include, for example, binding agents based on polyesters, epoxy resin esters, (meth)acrylic copolymer resins, maleinate oils or polybutadiene oils, with an average molecular weight (Mw) of, for example, 300–10000, and an acid number of 35–300 mg KOH/g. In particular for producing the second coating layer, binding agents which are based on polyesters or (meth)acrylic copolymer resins are preferably used as the anodically depositable binding agents. The binding agents contain —COOH, —$SO_3H$ and/or —$PO_3H_2$ groups. The resins can be reduced to the aqueous phase after neutralization of at least a part of the acid groups. The binding agents may be self-crosslinking or they may require an additional crosslinker. Accordingly, it is also possible for the lacquers to contain the usual cross-linking agents, e.g. triazine resins, cross-linking agents which contain groups capable of transesterification or blocked polyisocyanates.

It is also possible to use the usual cathodic electro-dipcoat lacquers (KTL) based on cationic or basic binding agents in the process according to the invention to produce the first and/or the second coating layer. Such basic resins are, for example, resins containing primary, secondary and/or tertiary amino groups, the amine values of which are, for example, in the range from 20 to 250 mg KOH/g. The average molecular weight (Mw) of the basic resins is preferably from 300 to 10000. Examples of such basic resins are amino epoxy resins, amino epoxy resins with terminal double bonds, amino epoxy resins with primary OH groups, amino polyurethane resins, polybutadiene resins containing amino groups, or modified epoxy resin carbon dioxide/amine conversion products, and the amino(meth)acrylate resins, which are preferably used for producing the second coating layer. These base resins may be self-crosslinking or they are used in mixtures with known cross-linking agents. Examples of such cross-linking agents are aminoplastic resins, blocked polyisocyanates, cross-linking agents with terminal double bonds, polyepoxide compounds or cross-linking agents which contains groups which are capable of transesterification.

Examples of base resins and cross-linking agents which may be used for cathodic dipcoating (KTL) baths are described in EP-A-0 082 291, EP-A-0 234 395, EP-A-0 227 975, EP-A-0 178 531, EP-A-0 333 327, EP-A-0 310 971, EP-A-0 456 270, U.S. Pat. No. 3,922,253, EP-A-0 261 385, EP-A-0 245 786, DE-A-33 24 211, EP-A-0 414 199, EP-A-0 476 514. These resins may be used singly or in mixtures thereof. With particular preference, so-called "non-yellowing" KTL systems, in which a yellowing or discoloration of the multilayer lacquers produced according to the process according to the invention is prevented during stoving, are used. By way of example, these are KTL systems which cross-link by means of specially selected blocked polyisocyanates, as described, for example, in EP-A-0 265 363.

The electro-dipcoat (ETL) coating agent (I) contains components which impart electrical conductivity. Said components are intended to give the first coating layer, in the stoved state, a sufficiently low specific resistance, for example between $10^3$ and $10^8$ Ohm cm, for the electrophoretic deposition of a further coating layer of an electrophoretically depositable coating agent (II). Examples of these components are particulate inorganic or organic electric conductors or semiconductors, such as, for example, iron oxide black, graphite, conductive carbon black, metal powder, for example, of aluminium, copper or special steel, molybdenum disulphide or also polymers having electrical conductivity, e.g. preferably polyaniline. Examples of electro-dipcoat lacquers which contain these components and which may be used according to the invention are set out in U.S. Pat. No. 3,674,671, GB 2 129 807, EP-A-0 409 821 and EP-A-0 426 327. The components imparting electrical conductivity are contained in the ETL coating agent (I) in a quantity such that the desired specific resistance of the deposited coating layer is achieved in the stoved state. Relative to the solids content of the ETL coating agent (I), the quantity of the component or components imparting electrical conductivity is, for example, between 1 and 30% by mass. The quantity is readily determined by the person skilled in the art; it is, for example, dependent on the relative density, the specific electrical conductivity and the particle size of the components used for imparting electrical conductivity. One or a combination of more such components may be used.

In addition to the base resins and the optionally present cross-linking agents, and the components which are contained in the ETL coating agent (I) and impart electrical conductivity to the first coating layer in the stoved state, and in addition to the colour-giving and/or effect-producing pigments contained in the ETL coating agent (II), it is possible for the ETL coating agents (I) and (II) to contain filler substances and/or the usual additives for lacquers. It is, of course, possible for the ETL coating agent (I) to contain pigments. The pigments include, for example, the usual inorganic and/or organic colour pigments and/or effect-producing pigments such as, for example, titanium dioxide, iron oxide pigments, phthalocyanine pigments, quinacridone pigments, metal pigments, e.g. of titanium, aluminium or copper, interference pigments, such as, for example, titanium dioxide-coated aluminium, coated mica, graphite-effect pigments, plate-like iron oxide, plate-like copper phthalocyanine pigments. Examples of black pigments are coarse coal, fine-particled carbon black obtained by incomplete combustion, coarse-particled carbon black obtained by catalytic or thermal decomposition of liquid or gaseous hydrocarbons. Examples of filler substances are kaolin, talcum or silicon dioxide.

It is possible for the pigments to be dispersed to form pigment pastes, e.g. using known paste resins. Such resins are well known to the person skilled in the art. Examples of paste resins which may be used in KTL baths are described in EP-A-0 183 025 and in EP-A-0 469 497. In particular in the case of the ATL coating agents, which are preferably used for producing the second coating layer, it is possible to use pigment pastes such as they are used in aqueous base coats, which are known to the person skilled in the art and are suitable for producing double-layer lacquer coatings of the base lacquer/clear lacquer type. Such pigment pastes may be obtained by preparing a paste of the pigments in a special water-dilutable pasting resin. An example of a pasting resin of this kind which is preferably used and is based on an anionically stabilized polyurethane resin is given in DE-A-040 00 889.

The additives include the usual additives such as those which are, in particular, known f or ETL coating agents. Examples hereof are wetting agents, neutralizing agents, leveling agents, catalysts, corrosion inhibitors, anti foam additives, solvents, but, in particular, also light-protection agents, optionally in combination with anti-oxidant agents.

In the process according to the invention, it is preferred to use a KTL coating agent as the ETL coating agent (I), and an ATL coating agent as the ETL coating agent (II).

As the clear lacquer coating agent for producing the third and, if required, any additional coating layers, all the usual clear lacquers or transparent colored or colorless pigmented coating agents are, in principle, suitable. These may include single-component or multi-component clear lacquer coating agents. They maybe solvent-free (liquid, or in the form of clear lacquer powder), or they may be solvent-based systems or they may be water-dilutable clear lacquers, the binding agent systems of which are stabilized in a suitable manner, e.g. an ionically, cationically or non-ionically. The water-dilutable clear lacquer systems may be systems which are water-soluble or dispersed in water, for example emulsion systems or powder slurry systems. The clear lacquer coating agents harden during stoving, while forming covalent bonds as a result of chemical cross-linking.

The clear lacquers which may be used in the process according to the invention include the usual clear lacquer coating agents which contain one or more of the usual base resins as film-forming binding agents. In the event that the base resins are not self-crosslinking, they may optionally also contain cross-linking agents. No restrictions are imposed on the base resin component or on the component of cross-linking agent. Polyester, polyurethane and/or (meth)acrylic copolymer resins may, for example, be used as the film-forming binding agents (base resins). The selection of the optionally contained cross-linking agents is noncritical, said selection depending on the functionality of the base resin, i.e. the cross-linking agents are selected such that they have a reactive functionality which is complementary to the functionality of the base resins. Examples of such complementary functionalities between the base resin and the cross-linking agent are: carboxyl/epoxide, hydroxyl/methylol ether directly bonded to carbon or silicon, hydroxyl/free and/or blocked isocyanate directly bonded to carbon or silicon, and a (meth)acryloyl/CH acid group. In this connection, the term 'hydroxyl groups directly bonded to silicon' is also understood to include latent silanol groups, e.g. alkoxy silane groups. In so far as they are compatible, it is also possible for a plurality of such complementary functionalities to be present in parallel in a clear lacquer. The cross-linking agents optionally used in the clear lacquers may be present singly or in mixtures thereof.

In addition to the chemically cross-linking binding agents and, optionally, the cross-linking agents, it is possible for the clear lacquers which may be used in the process according to the invention to contain the usual additives for lacquers, such as, for example, catalysts, leveling agents, dyes, but in particular rheology-controlling agents, such as microgels, NAD's (=non-aqueous dispersions), di-substituted ureas ("sagging control agents"), as well as light-protection agents, optionally in combination with anti-oxidant agents.

Examples of single-component (1K) and two-component (2K) non-aqueous clear lacquer systems, which may be used as the clear lacquer in the process according to the invention, are given in DE-A-38 26 693, DE-A-40 17 075, DE-A-41 24 167, DE-A-41 33 704, DE-A-42 04 518, DE-A-42 04 611, EP-A-0 257 513, EP-A-0 408 858, EP-A-0 523 267, EP-A-0 557 822, WO-92 11 327.

Examples of single-component (1K) or two-component (2K) water-based clear lacquer systems, which may be used as the clear lacquer in the process according to the invention, are given in DE-A-39 10 829, DE-A-40 09 931, DE-A-40 09 932, DE-A-41 01 696, DE-A-41 32 430, DE-A-41 34 290, DE-A-42 03 510, EP-A-0 365 098, EP-A-0 365 775, EP-A-0 496 079, EP-A-0 546 640.

Examples of the clear lacquer powder systems preferably used for producing the transparent coating layer in the process according to the invention are set out in EP-A-0 509 392, EP-A-0 509 393, EP-A-0 522 648, EP-A-0 544 206, EP-A-0 555 705, DE-A-42 22 194, DE-A-42 27 580.

It is possible for the transparent coat to be applied in a single coat or in the form of a plurality of coats of the same or of a plurality of different transparent coating agents. It is, however, expedient for the transparent coating layer to be applied as the third coat and comprising only one clear lacquer coating agent. In this regard, it is preferable to use clear lacquer coating agents which have the lowest possible run-off tendency, for example clear lacquers which have a high solids content and a correspondingly adjusted rheological behavior. Clear lacquer powders are particularly preferred.

Electrically conductive materials, such as, for example, metals, are well suited as the substrate for the process according to the invention. Particularly suitable are, for example, car bodies or parts thereof; they may be of pretreated or of untreated metal, or of electrically conductive plastics material, or of a plastics material provided with an electrically conductive coat. The first coating layer, comprising the aqueous coating agent (I) is electrophoretically deposited on to these substrates in the usual manner in a dry layer thickness of, for example, 5 to 15 $\mu$m, and then stoved, for example at temperatures of between 130 and 180° C.

On to the resultant substrate, which is provided with an ETL coat which has a specific resistance of, in particular, $10^3$ to $10^8$ Ohm cm, is applied the electrophoretically depositable colour-giving and/or effect-producing second coating layer, comprising the second coating agent (II), which is different from (I), in a dry layer thickness of, for example, 10 to 45 $\mu$m, preferably 15 to 30 $\mu$m, and is then also stoved, for example at temperatures of between 130 and 180° C. The second coating layer is generally not electrically conductive, i.e. in the stoved state, it has a specific resistance generally in excess of $10^9$ Ohm cm.

The coating obtained from the coating agent (I) as a result of electro-dipcoating serves, in particular, as a protection against any chemical or corrosive attack, with the result that it is advantageous for the entire surface of a three-dimensional substrate, for example a car body, to be coated.

The colour-giving and/or effect-producing coating which is obtained from the coating agent (II) as a result of electro-dipcoating and is electrically insulating in the stoved state may extend, but need not extend, across the entire surface of the three-dimensional substrate; accordingly, a possible double-coating comprises a first coating, covering the entire surface, in electro-dip coating of a first coating agent (I) and a colour-giving and/or effect-producing coat comprising the coating agent (II) by electro-dipcoating, for example, essentially only on the outer regions, in particular the visible surfaces of a three-dimensional substrate, i.e. for example not in narrow hollow spaces of a car body.

The above operation is followed by the application of the clear lacquer. The third coating layer of the usual liquid clear lacquer or a clear lacquer powder is applied and the item is then stoved, for example at temperatures from 80 to 160° C. It is, optionally, possible for additional layers of clear lacquer, comprising the same or different clear lacquer coating agents, to be applied. According to the invention, the applications are controlled such that the layer thickness of the transparent coating layer or the overall layer thickness of the transparent coating layers is between 40 and 80 $\mu$m, particularly preferably between 50 and 60 $\mu$m.

The process according to the invention makes it possible to produce multilayer lacquer coatings, in particular lacquer coatings for motor vehicles with an overall level of properties which is comparable to the state of the art and with an improved luster and condition of the covering lacquer. It has been found that excellent properties are achieved by the process according to the invention, although said process makes it possible to dispense with the usual sprayed filler layers. Despite a high layer thickness when applying the clear lacquer, the overall layer thicknesses of the multilayer lacquers produced according to the process according to the invention are very low. They are, in particular, of the order of 80 to 110 $\mu$m and are less than the range of the usual first lacquer coatings for motor vehicles with a comparably high layer thickness of the clear lacquer coat.

We claim:

1. A process for producing a multilayer lacquer coating comprising:

electrophoretically applying a primer of an electrophoretically depositable aqueous coating agent (I) onto an electrically conductive substrate, thereby forming a primer coat;

stoving said primer coat;

applying a base lacquer coat using an aqueous coating agent (II), said base lacquer coat comprising at least one member selected from the group consisting of a color-giving base lacquer coat and an effect-producing base lacquer coat;

staving said base lacquer coat;

applying one or more clear lacquer coats; wherein:

(a) the aqueous coating agent (I) comprises a coating agent which, after stoving, will produce an electrically conductive primer coat;

(b) the aqueous coating agent (II) which forms the base lacquer coat is electrophoretically depositable, and the base lacquer coat is formed by a process of electrophoretical deposition;

(c) overall dry layer thickness of the one or more clear lacquer coats is about 40 to 80 μm; and (d) overall dry layer thickness of the multilayer lacquer coating is about 80 to 110 μm.

2. A process according to claim 1, wherein the overall dry layer thickness of the one or more clear lacquer coats is about 50 to 60 μm.

3. A process according to claim 1, comprising applying said multilayer lacquer coating to motor vehicles or motor vehicle parts.

4. A process according to claim 2, comprising applying said multilayer lacquer coating to motor vehicles or motor vehicle parts.

5. A process according to claim 1, wherein an anodically depositable coating agent is used as the coating agent (II) for producing the base lacquer coat.

6. A process according to claim 1, wherein dry layer thickness of the primer coat is 5 to 15 μm, and dry layer thickness of the base lacquer coat is 10 to 45 μm.

7. A process according to claim 1, comprising producing at least one of the clear lacquer coats using a powder coating.

* * * * *

UNITED STATES PATENT AND TRADEMARK OFFICE

CERTIFICATE OF CORRECTION

PATENT NO. : 5,908,667

DATED : June 1, 1999

INVENTOR(S) : BLUM et al.

It is certified that error appears in the above-indentified patent and that said Letters Patent is hereby corrected as shown below:

Col. 1, line 28, change "no" to --on--;
line 42, delete the "f" at the end of the line; and
line 43, change "or" to --for--.

Col. 2, line 34, change "guaternary" to --quaternary--.

Col. 4, line 34, change "f or" to --for--; and
line 51, change "an ionically" to --anionically--.

Col. 6, line 66, change "staving" to --stoving--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*